United States Patent [19]

Francis

[11] Patent Number: 4,956,949

[45] Date of Patent: Sep. 18, 1990

[54] BRICK PANEL WALL CONSTRUCTION

[75] Inventor: Gerald T. Francis, 41757 Onaway Dr., Northville, Mich. 48167

[73] Assignee: Gerald T. Francis, Northville, Mich.

[21] Appl. No.: 357,133

[22] Filed: May 25, 1989

[51] Int. Cl.[5] ..... E04F 13/08; E04C 1/14

[52] U.S. Cl. ..... 52/38; 52/442; 52/391

[58] Field of Search ..... 52/389-392, 52/442, 509, 361-363, 593

[56] References Cited

U.S. PATENT DOCUMENTS

| | | | |
|---|---|---|---|
| 2,003,996 | 6/1935 | Finzer et al. | 52/275 |
| 2,300,258 | 10/1942 | Kublanow | 52/774 |
| 2,317,428 | 4/1943 | Anderson | 52/509 |
| 2,924,963 | 2/1960 | Taylor et al. | 52/442 |
| 2,938,376 | 5/1960 | Workman et al. | 52/314 |
| 3,908,326 | 9/1975 | Francis | 52/592 |
| 4,407,104 | 10/1983 | Francis | 52/593 |
| 4,407,107 | 10/1983 | Francis | 52/593 |
| 4,641,473 | 2/1987 | Trezza | 52/410 |

*Primary Examiner*—James L. Ridgill, Jr.
*Attorney, Agent, or Firm*—Dykema Gossett

[57] ABSTRACT

A brick panel wall construction is disclosed including a backing board for a brick panel which is formed of extruded plastic foam for moisture resistance and insulating. The wall construction includes a plurality of brick panels having plastic foam backing boards and a plurality of panel clips which support the backing board against the supporting structure and, when mortar is applied and cured, support the bricks which are secured to the backing boards. Each panel clip is attached at two locations, one to the backing board and the second through the backing board into the supporting structure. Further, legs extend outwardly from the panel clips into the mortar joints to provide a direct mechanical connection between the bricks mounted on the backing board and the supporting structure. These legs have retaining lips configured to create a wedge like action to provide additional support.

20 Claims, 1 Drawing Sheet

BRICK PANEL WALL CONSTRUCTION

BACKGROUND OF THE INVENTION

The present invention relates to an improved brick panel wall construction and more particularly to a panel clip for use in fastening a brick panel to supporting structure.

It has become commonplace to use pre-fabricated brick panels instead of conventional bricks in original construction and in remodeling applications. Pre-fabricated brick panels generally consist of one-half inch thick kiln-fired bricks secured in conventional patterns to a backing board by means of an adhesive. The backing board is typically formed of an asphalt-impregnated wood fiber material sixteen inches high by forty-eight inches long, so as to receive six rows of two and one-quarter inch high by seven and five-eighths inch long bricks. The brick panels are applied to the supporting structure by hand-driven or power-driven nails through the open spaces between the bricks. Mortar is then applied to these three- eighth inch or half-inch wide spaces to conceal the joints between adjacent panels, to conceal the nails, and also to render the completed installation indistinguishable from conventional brick constructions. Examples of brick panels are found in Applicant's prior U.S. Pat. No. 3,908,326 and in the prior art referred to therein.

To improve upon the brick panel disclosed in Applicant's '326 patent, Applicant invented a brick panel wall construction that utilizes polystyrene foam backing boards and a plurality of load bearing clip members that support the bricks attached to the backing board. This invention is disclosed in U.S. Pat. No. 4,407,104. The polystryene foam backing board of the '104 patent has several advantages including improved moisture resistance to avoid rotting or delamination and improved insulation to conserve energy.

An important feature of the '104 patent is the individual load bearing clips which provide direct mechanical connection between the bricks and the supporting wall structure. Each load bearing clip includes an outwardly projecting leg having a protruding lip which extends into the joint area between the bricks of adjacent panels. When mortar is packed or tuck pointed into the joint area to cover the protruding lips of the load bearing clips, the clips become a direct mechanical connection to the support structure for the bricks that are secured to the polystryene foam backing boards. In fact, the backing boards of Applicant's '104 invention may be stripped away and the brick walls will remain intact, being supported solely by the load bearing clips.

Although the brick panel wall construction described in Applicant's '104 patent has been extremely successful, Applicant has found the need to make improvements.

One such improvement is the need for further support, especially at the mid-portion of the panel, when the brick panels are being mounted to the support structure. Typically, each of the panels of the brick wall panel construction is sixteen inches high between top and bottom. As described in the '104 patent, the load bearing clips hold the top and bottom of the panels with mortar being applied to the joints to fix the brick to the clip and support structure. However, if mortar is not applied immediately after the panels are attached to the support structure, the loading of the bricks on the backing board can cause the panel to drift in a vertical plane which is undesirable. This vertical drift causes the panel to bow outwardly between the load bearing clips.

To overcome bowing, Applicant applies adhesive between the polystryene backing board and the supporting structure. Although this solves the problem, it cannot be used if a vapor permeable moisture barrier underlay is used because the underlay is typically made of, for example, 15# felt to which the adhesive would not gain support. Vapor permeable underlays are commonly used because damage to the backing board during installation can allow moisture to develop between the backing board and the support structure. Therefore, applicant needed a means to attach the panel, preferably at the midpoint, to the support structure and still permit an underlay to be used.

Another area for improvement is in the mounting of brick panel sections to supporting structure at locations where the load bearing clips cannot be used. One such location is at sill sections. Due to sills typically having metal trim or wooden overhangs, the load bearing clip cannot be used at the top of the panel. Typically, at these locations the panel is nailed to the support structure with galvanized scaffold nails. Although this is satisfactory, Applicant wanted a better means of attaching the panel to the support structure at sill projections and roof soffits and where a typical load bearing clip cannot be used.

SUMMARY OF THE INVENTION

The brick panel wall construction of the present invention includes a plurality of brick panels which are secured to supporting structure. Each brick panel includes a plurality of bricks secured to a backing board which is preferably extruded polystryene foam. The bricks are secured to the backing board by adhesive. Mortar is applied to the spaces between the bricks to conceal the joints between adjacent bricks.

An important feature of the present invention resides in the use of intermediate panel clips which provide support for the brick panels. The intermediate panel clips of the present invention are adapted to be mounted within the mortar joints between adjacent bricks with a fastening means extending through the backing board and into the supporting structure. The backing board is thus retained against the supporting structure by the intermediate clip until mortar is applied in the joint. Once mortar is cured, it cooperates with the intermediate panel clip to form a direct mechanical connection between the bricks and the support structure.

Preferably, the intermediate panel clips are used in conjunction with the load bearing clips of Applicant's prior invention described in U.S. Pat. No. 4,407,104, which is incorporated herein by reference. The intermediate panel clips are positioned mid-way between the load bearing clips so that the brick panel is supported at eight inch intervals. Applicant has determined that this is sufficient to prevent bowing. However, it should be understood that the intermediate panel clips of the present invention can be used alone without the need for other types of clips and can be used on other types of brick panel wall constructions.

The intermediate panel clip of the present invention includes a body portion which acts against the polystryene backing board to support the backing board prior to mortar being applied. The intermediate panel clip is mounted within the mortar joint between adjacent bricks by two separate attaching means. A primary attaching means, such as a nail, which extends through the intermediate panel clip and backing board into the support structure and a secondary attaching means which is a lip that protrudes from the body portion into the backing board. In the preferred embodiment, the secondary fastening lip extends the full length of the intermediate panel clip so that downward forces are distributed along the length of the intermediate clip. Without the inwardly protruding lip, all downward forces on the panel would be focused on the primary fastener which could result in the fastener cutting through the backing board prior to application of mortar.

Additionally, the body portion has at least one leg that protrudes outwardly from the body portion into the mortar joint. This leg terminates in a specially configured retaining lip which cooperates with the cured mortar to provide load bearing support for the bricks. The retaining lip is generally sinusoidally configured along its longitudinal extent to resist loads on the wall construction. This retaining lip rises above a longitudinally extending line parallel to the body portion at a slope of approximately 7.5 degrees and falls below the same line at an equal slope. Thus, when mortar is applied to the mortar joint and cures the retaining lip acts as a wedge, holding the mortar in place and preventing the brick panel from pulling away from the support. Also, the generally equal rise and fall permits the intermediate clip to be installed in any direction.

Other advantages and meritorious features of the brick panel wall construction of the present invention will be more fully understood from the following description of the preferred embodiment, the appended claims and the drawings, a brief description of which follows.

DETAILED DESCRIPTION OF THE INVENTION

Figure 1:
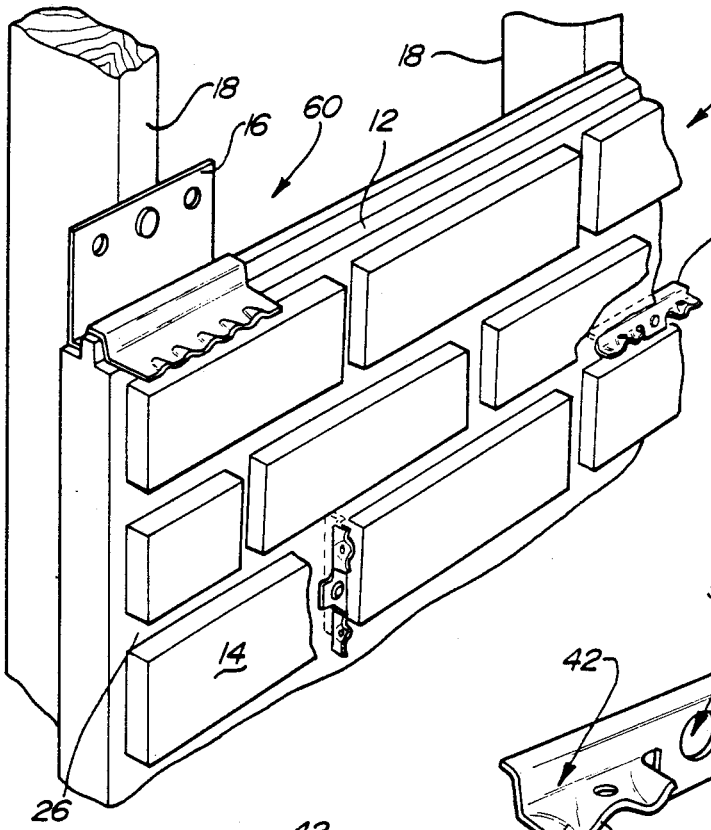
FIG. 1 is a perspective view of a brick panel attached to a stud wall including a load bearing clip and intermediate panel clips of the present invention.

Referring to FIG. 1, a brick panel 10 is illustrated which includes a backing board 12 to which a plurality of bricks 14 are adhesively secured in a conventional pattern. Bricks 14 are preferably one-half inch thick by two and one-quarter inches wide by seven and five-eighths inches long kiln-fire bricks.

Backing board 12 is preferably formed of extruded polystryene foam one-inch or two-inch thick by sixteen inches high by forty-eight inches long. Styrofoam SM brand insulation board manufactured by the Dow Chemical Company has been found to produce good results in the present brick panel wall construction, since it possesses the desired moisture resistance, insulation and strength properties. Preferably, the backing boards 12 are extruded with tongue and groove joints on all four edges to improve structural integrity, insulation value and water run-off.

In the illustrated embodiment, the assembled wall panels are mounted to studs 18 by individual load bearing clip members 16. The load bearing clip members 16 are sandwiched within the tongue and groove joints between adjacent upper and lower brick panels. Mortar is packed into the mortar joints to cover the protruding lips of the load bearing clips, and the load bearing clips become the support for the bricks that are secured to the backing boards after the mortar cures. The load bearing clip members and brick panel wall construction illustrated in FIG. 1 are more completely described in Applicant's U.S. Pat. No. 4,407,104 entitled "Brick Panel Insulation with Load Bearing Clip" which is included herein by reference. It should be understood that the use of load bearing clip members 16 is preferred; however, their use is optional when the intermediate panel clips 40 of the present invention are used.

Figure 2:
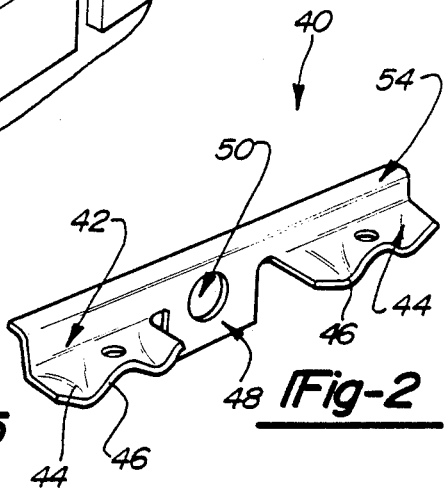
FIG. 2 is a perspective view of the preferred embodiment of the intermediate panel clip of the present invention.

With reference to FIG. 2, a perspective view of an intermediate panel clip 40 of the present invention is illustrated. Intermediate clip 40 includes a body portion 42 which is configured to fit within the mortar joint 26 between adjacent bricks 14. The intermediate clips 40 can be placed in the horizontal or vertical directions as well as either right side up or upside down, see FIG. 1. Extending outwardly from body portion 42 are legs 44 which end in retention lips 46. Legs 44 are separated by a mounting tab 48 which depends downwardly from body portion 42. A mounting hole 50 extends through body portion 42 and mounting tab 48. Hole 50 is adapted to receive a primary fastening means 52, such as for example a nail, see FIG. 6. A secondary mounting lip 54 extends from the top of body portion 42 in a direction opposite to legs 44. Mounting lip 54 extends into backing board 12 when intermediate panel clip 40 is mounted in the mortar joint.

Figure 3:
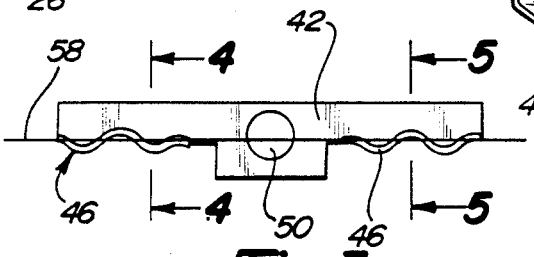
FIG. 3 a front elevational view of the preferred embodiment of the intermediate panel clip of the present invention.

Referring to FIG. 3, the retention lip 46 of each leg 44 has a generally sinusoidal configuration which sequentially rises above and falls below a longitudinally extending line 58 parallel to body portion 42. In the preferred embodiment, the retaining lip rises at a slope of approximately 7.5 degrees to line 58 and falls at a generally equal slope.

Figure 4:
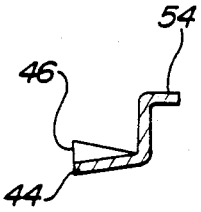
FIG. 4 is a cut-away view of the preferred embodiment of the intermediate panel clip taken along line 4—4 of FIG. 3.
Figure 5:
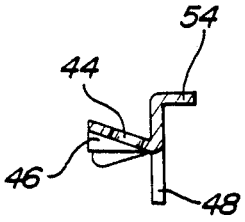
FIG. 5 is a cut-away view of the preferred embodiment of the intermediate panel clip taken along line 5—5 of FIG. 3.

With reference to FIGS. 4 and 5, the effect of this sinusoidal configuration is illustrated. FIG. 4 is a section taken along line 4—4 of FIG. 3 and illustrates the downward slope of retaining lip 46. FIG. 5 is a section taken along line 5—5 of FIG. 3 and illustrates the rising slope of retaining lip 46. This sloping of the retaining lips provides a wedge-shaped configuration to prevent the panel, when mortar is applied and cured, from bowing out from the support studs 18 and to assist in retaining the mortar 62 within the mortar joint 26. The effective wedge which results from the sinusoidal configuration is further illustrated in FIG. 6.

The generally equal slopes of the retaining lips 46 permit the intermediate clips 40 to be installed in any direction and still be effective to prevent movement of the panel. This can be seen in FIG. 1 where various orientations are illustrated. Further, this flexibility in mounting the intermediate clips 40 permits greater versatility in mounting the brick panel 10 to support structures. For example, Applicant has discovered that it is difficult to mount the brick panels at certain locations, such as under sill projections or immediately below roof soffits. Previously, Applicant used 8*d* galvanized scaffold nails which were driven through the backing board at the mortar joint 26 and into the support 18. The disadvantage in using scaffold nails is that the relatively small heads are insufficient to resist the outward movement of the panel and they have a tendency to pull through the foam backing board. The intermediate panel clips 40 can be used at the same locations where scaffold nails are commonly used without this difficulty. Further, the intermediate panel clips 40 give the added benefit of a direct connection between the bricks and the support structure.

With reference to FIGS. 1 through 6, assembly of a brick panel wall construction using the intermediate panel clips 40 of the present invention will be described. Preferably, the wall panel 12 is preassembled with a plurality of bricks 14 adhesively secured in a conventional pattern to a backing board 12. Further, in the preferred embodiment, a vapor permeable moisture barrier 60, which may be for example building paper, also known as 15 pound felt, is positioned between the supports 18 and the brick panel 10. The vapor permeable barrier is of conventional construction and prevents moisture from penetrating through the brick panel 10 to the support structure 18. The brick panel 10 is positioned against the vapor permeable moisture barrier 60 and then attached to the support structure by use of load bearing panel clips 16. Intermediate clips 40 are then positioned in the mortar joints between adjacent bricks and a fastener 52 is driven into hole 50 through the backing board 12, felt 60 and into the support structure 18. When the fastener 52 is completely driven into the support 18, inwardly protruding mounting lip 54 is driven into the backing board 12. Mounting lip 54 prevents any vertical slippage of the brick panel 10 by distributing the downward load of the panel across the entire length of the intermediate clip instead of having the downward forces concentrated on fastener 52.

Figure 6:
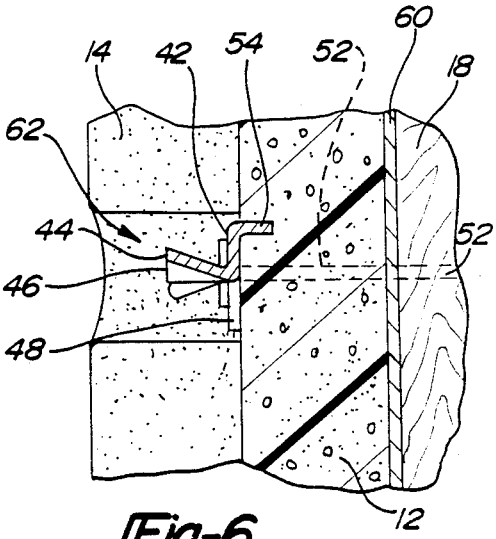
FIG. 6 is a fragmentary side elevational view illustrating the intermediate panel clip of the present invention and two adjacent bricks after mortar has been applied.

Once intermediate clips 40 are in place and fastened to support structure 18, mortar 62 is applied to the mortar joints 26 covering the legs 44 and retention lips 46. Preferably, a latex modified high bond mortar is used. To facilitate bonding of the mortar about the legs 44 of intermediate panel clips 40, holes 64 are provided in legs 44. As illustrated in FIG. 6, the sinusoidal retaining lips 46 act as a wedge to prevent any bowing of the panel 10 from the support structure 18. Once the mortar 62 is applied and solidifies, there is a direct mechanical connection between the bricks 14 and the support structure 18.

The preferred function of intermediate panel clips 40 is to prevent bowing of the brick panels 10 outwardly from support structure 18. In this regard, the intermediate panel clips 40 are ideally suited for use on brick panel wall constructions as defined in Applicant's U.S. Pat. No. 4,407,104. In this use, the clips are actually mid-panel clips and are positioned between the load bearing clips 16 as illustrated in FIG. 1. A further use of the intermediate panel clips of the present invention is to fasten the brick panels 10 to the support structure 18 when it is difficult or impossible to use load bearing clips 16. In this use, the intermediate panel clips 40 may be the sole fastening means. Still further, the intermediate panel clips 40 are capable of being the sole fastening means in a brick panel wall construction.

It will be apparent to those skilled in the art that the foregoing disclosure is exemplary in nature rather than limiting, with the invention being limited only by the appended claims:

What is claimed is:

1. A brick panel wall construction having a plurality of brick panels, said brick panels being secured to supporting structure, each brick panel including a backing board having a plurality of bricks secured thereto in a pattern with adjacent bricks separated by mortar joints said mortar joints having a back wall and side walls;

at least one fastening means having a body portion mounted in said mortar joint between adjacent bricks said body portion being defined by a generally planar surface, said planar surface being juxtaposed with said back wall, said body portion having at least two attaching means, a first attaching means for attaching said body portion to said supporting structure and a second attaching means for attaching said body portion to said backing board said second attaching means extending only partially into said backing board; and mortar applied to said mortar joint to cover said fastening means.

2. The brick panel wall construction of claim 1, wherein said second attaching means for attaching said body portion to said backing board includes an inwardly protruding lip extending into said backing board to resist downward forces acting upon said brick panel wall construction.

3. The brick panel wall construction of claim 1, wherein said body portion has a longitudinal length greater than the width of said mortar joint, whereby said backing board is held against said support structure and said body portion does not pull through said backing board.

4. The brick panel wall construction of claim 1, wherein said body portion includes a mounting tab depending from said body portion.

5. The brick panel wall construction of claim 1, wherein said first attaching means includes a hole extending through said body portion and a fastening means extending through said hole and said backing board into said supporting structure.

6. The brick panel wall construction of claim 1, wherein said fastening means further includes at least one leg protruding outwardly from said body portion into said mortar joint, said leg terminating in a retaining lip;

said mortar being applied to said mortar joints to cover said leg portion and retaining lip of said fastening means providing load bearing support for the bricks that are secured to said backing boards.

7. The brick panel wall construction of claim 6, wherein said retaining lip is generally sinusoidally configured along its longitudinal extent for resisting loads on said wall construction.

8. The brick panel wall construction of claim 6, wherein said retaining lip sequentially rises above and falls below a longitudinally extending line parallel to said body portion and falls above and below said line.

9. The brick panel wall construction of claim 8, wherein said lip rises at a slope of approximately 7.5 degrees to said line and falls at a generally equal slope.

10. A brick panel wall construction including a plurality of brick panels, said brick panels being secured to said supporting structure, each brick panel including a backing board having a plurality of bricks secured thereto in a pattern with adjacent bricks separated by mortar joints said mortar joints having a back wall and side walls;

at least one fastening means having a body portion mounted in the mortar joint between adjacent bricks said body portion being defined by a generally planar surface, said planar surface being juxtaposed with said back wall, said body portion having means for attaching said body portion to said supporting structure to support said backing board prior to mortar being applied to said mortar joints, said attaching means including a piercing member extending from said body portion through said backing board and into said supporting structure and at least one leg protruding outwardly from said body portion into said mortar joint, said leg terminating in a retaining lip; and mortar applied to the mortar joints to cover the leg of the fastening means providing load bearing support for the bricks that are secured to said backing board.

11. The brick panel wall construction of claim 10, wherein said fastening means includes an inwardly protruding lip extending into said backing board to resist downward forces acting upon said wall construction.

12. The brick panel wall construction of claim 10, wherein said body portion has a longitudinal length greater than the width of said mortar joint whereby said backing board is held against said support structure and said body portion does not pull through said backing board.

13. The brick panel wall construction of claim 10, wherein said body portion includes a mounting tab depending from said body portion.

14. The brick panel wall construction of claim 10, wherein said attaching means includes a hole extending through said body portion and a fastening means extending through said hole and said backing board into said supporting structure.

15. The brick panel wall construction of claim 10, wherein said retaining lip is generally sinusoidally configured along its longitudinal extend for resisting loads on said wall construction.

16. The brick panel wall construction of claim 10, wherein said retaining lip sequentially rises above and falls below a longitudinally extending line parallel to said body portion.

17. The brick panel wall construction of claim 16, wherein said rise is at a slope of approximately 7.5 degrees to said line and said fall is at a generally equal slope.

18. A panel clip for use in supporting a wall construction having a plurality of brick panels, said brick panels being secured to supporting structure, each brick panel including a backing board having a plurality of bricks secured thereto in a pattern with adjacent bricks separated by mortar joints;

said panel clip having a body portion adapted to be mounted in said mortar joint between adjacent bricks with;

a first attaching means having at least one leg protruding outwardly from said body portion and adapted to extend into said mortar joint, said leg terminating in a retaining lip;

a second attaching means including a protruding lip extending in a direction opposite to said first attaching means and adapted to extend partially into said backing board to resist downward forces acting upon said brick panel wall construction and a third piercing means extending from said body portion adapted to pierce said backing board and supporting structure;

said panel clip being adapted to be inserted between the mortar joints of said brick panel construction such that said body portion is juxtaposed with the base of the mortar joint, said second attaching means extends into the backing board, said piercing means pierces said backing board and supporting structure and said first attaching means extends outwardly into the mortar joint such that mortar can be applied to said mortar joints to cover said leg portion and retaining lip of said fastening means providing load bearing support for the bricks that are secured to said backing boards.

19. The brick panel wall construction of claim 18, wherein said body portion has a longitudinal length greater than the width of said mortar joint, whereby said backing board is held against said support structure and said body portion does not pull through said backing board.

20. The brick panel wall construction of claim 18, wherein said first attaching means includes a hole extending through said body portion and a fastening means extending through said hole and said backing board into said supporting structure.

* * * * *